US010941523B2

(12) United States Patent
Hernandez Rosario et al.

(10) Patent No.: US 10,941,523 B2
(45) Date of Patent: Mar. 9, 2021

(54) PROTECTIVE BARRIER COATING AND INK

(71) Applicant: Sonoco Development, Inc., Hartsville, SC (US)

(72) Inventors: Ismael Antonio Hernandez Rosario, Florence, SC (US); Aaron Edward Lintz, Florence, SC (US); Kevin Manly Kelley, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 16/418,039

(22) Filed: May 21, 2019

(65) Prior Publication Data

US 2019/0368128 A1 Dec. 5, 2019

Related U.S. Application Data

(60) Provisional application No. 62/677,282, filed on May 29, 2018.

(51) Int. Cl.

| | |
|---|---|
| ***D21H 19/84*** | (2006.01) |
| ***D21H 19/40*** | (2006.01) |
| ***D21H 19/16*** | (2006.01) |
| *D21H 27/30* | (2006.01) |

(52) U.S. Cl.
CPC ..... *D21H 19/84* (2013.01); *D21H 19/16* (2013.01); *D21H 19/40* (2013.01); *D21H 27/30* (2013.01)

(58) Field of Classification Search
None
See application file for complete search history.

(56) References Cited

U.S. PATENT DOCUMENTS

| | | | | |
|---|---|---|---|---|
| 4,855,354 | A | 8/1989 | Mohler et al. | |
| 5,144,056 | A * | 9/1992 | Lina | C07C 271/28 525/920 |
| 5,498,661 | A | 3/1996 | Hutter | |
| 6,066,373 | A | 5/2000 | Floyd, Jr. et al. | |
| 6,123,753 | A | 9/2000 | Craig et al. | |
| 6,416,817 | B1 | 7/2002 | Rangwalla et al. | |
| 9,751,721 | B1 | 9/2017 | Hernandez | |
| 2005/0266166 | A1 * | 12/2005 | Halsey | C10M 107/50 427/372.2 |
| 2007/0218292 | A1 * | 9/2007 | Shimada | C08L 33/26 428/411.1 |
| 2010/0224817 | A1 | 9/2010 | Jin | |

(Continued)

FOREIGN PATENT DOCUMENTS

| | | | |
|---|---|---|---|
| JP | 2005188016 | A | 7/2005 |
| JP | 2010149474 | A | 7/2010 |

(Continued)

*Primary Examiner* — Chinessa T. Golden
(74) *Attorney, Agent, or Firm* — von Briesen & Roper, s.c.

(57) ABSTRACT

A paperboard carrier suitable for use with textiles may include one or more strips of paperboard secured together to form a hollow tubular body, the body having an outer surface, and a coating covering some or all of the outer surface. The coating comprises a coating agent such as a silicon resin dispersed in a solvent such as isopropyl alcohol and little or no water. The coating may be applied to the outer surface by using a plurality spray nozzles arranged axially or circumferentially about the carrier.

18 Claims, 5 Drawing Sheets

(56) References Cited

U.S. PATENT DOCUMENTS

| | | | | |
|---|---|---|---|---|
| 2011/0057069 | A1 | 3/2011 | Hernandez | |
| 2012/0285645 | A1* | 11/2012 | Kusumi ..... | D21H 19/10<br>162/164.7 |

FOREIGN PATENT DOCUMENTS

| | | | |
|---|---|---|---|
| KR | 0166171 | B1 | 12/1998 |
| WO | WO2016044880 | A1 | 3/2016 |

* cited by examiner

PROTECTIVE BARRIER COATING AND INK

BACKGROUND

Field of the Invention

This patent relates to cones and tubes for carrying wound materials. More specifically, this patent relates to cones and tubes having a protective barrier coating to prevent the transfer of chemicals between the tube or cone and the material wound into the tube or cone.

Description of the Related Art

Tubes and cones (hereinafter collectively referred to as "tubes" or "carriers") made of spirally wound paper often are used to hold wound materials such as sheet materials, carpet, yarn and other stand materials. The carriers may be custom made to satisfy a customer's needs, and vary greatly through special finishing processes, chemical treatments, paper stock and adhesives. The degree of crush, beam and torque strengths can be controlled to customer specifications. Carriers can be made to resist moisture, oil, chemicals, heat and abrasion.

Carriers used for carrying yarn and other strand materials typically have a smooth surface. However, they can be embossed, scored, grooved, perforated, polished, flocked, waxed and ground to provide desired surface characteristics. Tubes can be made with special inside or outside plies and can be made plain, colored or printed with stripes and other designs. Alternatively, colored bands can be applied to one or both ends for identification purposes. Labels applied to the inside can be used for further identification. Tube ends can be cut, crimped, rounded, beveled or otherwise finished to the customer's order.

Spirally wound tubes are particularly useful for carrying textiles, including yarn and thread. The tube can be made of plain paper stock and, for the outermost ply, a colored paper stock or a paper stock with a pattern or design. The ends typically are rounded.

Yarns and other textiles are frequently coated with chemicals to provide a desired characteristic or property for downstream processing, such as low friction or anti-static. There have been cases of chemical transfer from the yarn to the tube carrier during or after winding. As these chemicals transfer to the tube, the downstream processing can deteriorate.

One initial solution to the problem of chemical transfer involved using specialty coverings on the surface of the tubes, such as parchment or greaseproof papers. However, there are drawbacks to using coverings. First, the covering is typically wound in a helical fashion onto the paperboard core, and hence there may be gaps between each wrap of the specialty paper around the paperboard core. Alternatively, the specialty paper may be overlapped on each wrap, but this creates undesirable bumps along the surface of the paperboard core at the overlapping joints. Second, in order to recycle specialty paper-covered paperboard cores, either the specialty paper must be removed prior to recycling, or else costly sorting and filtering equipment must be incorporated into the recycling machinery. Finally, as the textile manufacturers develop more sophisticated and/or aggressive coatings for their textiles, these coverings sometimes are not sufficient in preventing the chemical transfer from the textile to the tube.

The present disclosure addresses these drawbacks.

SUMMARY OF THE INVENTION

The present disclosure relates to a paperboard carrier suitable for use with textiles.

In one aspect a paperboard carrier suitable for use in winding a material thereon and including a barrier coating is provided. The carrier may include one or more strips of paperboard wrapped about an axis and secured together to form an elongate structure, the elongate structure defining an outer surface. The coating covers some or all of the outer surface. The coating comprises a coating agent dispersed in a solvent and little or no water. The coating agent may be a fluorourethane copolymer, a silicone resin, a fluoroalkyl acrylate copolymer emulsion or any other suitable coating agent. The solvent may be acetone, isopropyl alcohol (IPA), n-butyl acetate, mineral spirits, or other suitable solvent. The coating may be applied to the outer surface by using a variety of methods, such as applying with a kiss roll, spraying, or brushing.

In another aspect a paperboard carrier suitable for use in winding a material thereon and including an ink identifier is provided. The carrier comprises one or more strips of paperboard secured together to form a cylindrical elongate structure having an outer surface. An ink identifier is printed onto the outer surface in a predetermined region. The ink identifier has a barrier property that minimizes the transfer of chemicals between the ink identifier and the material. The ink identifier may comprise an aqueous based ink and a barrier compound. Alternatively, the ink identifier may comprise a solvent based ink and a barrier compound.

THE DRAWINGS

DETAILED DESCRIPTION OF THE INVENTION

Figure 1:
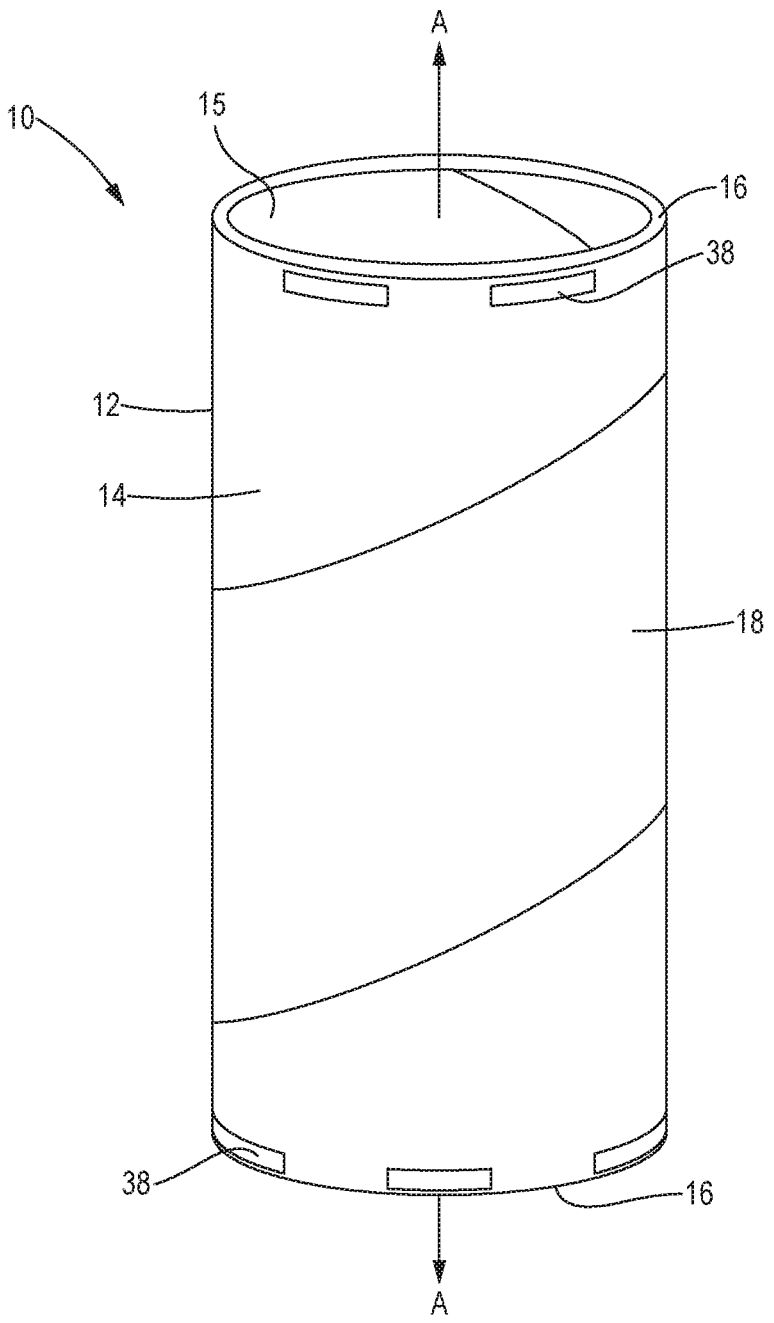
FIG. 1 is a perspective view of a tube.

While this invention may be embodied in many forms, there is shown in the drawings and will herein be described in detail one or more embodiments with the understanding that this disclosure is to be considered an exemplification of the principles of the invention and is not intended to limit the invention to the illustrated embodiments.

The present disclosure relates to using a coating on the paperboard tube to prevent yarn oil or other chemicals from migrating into paperboard core. As used herein, the term "coating" refers to a substance that is applied in a liquid form, as opposed to a solid.

The Carrier 10

FIG. 1 is a perspective view of a carrier 10, sometimes referred to as a tube or core. The carrier 10 may comprise a hollow cylindrical body 12 having an outer surface 14, an inner surface 15, opposing ends 16 and a middle section 18 between the ends 16. The carrier 10 also has an axial dimension extending from one end 16 to the other end 16 and a radial dimension extending radially outward from an axis A.

The carrier 10 may be used to carry stand material, such as yarn, or sheet material such as fabric, foil or paper. Typical tubes 10 for carrying textiles may have an outer diameter of three to four inches (7.62 to 10.16 cm) and may be about one foot (30.48 cm) in axial length, although the tubes 10 may be any suitable dimensions depending on the application. The carrier 10 may be made from any suitable material or combination of materials, including paper, plastic or even metal foil.

The carrier 10 may comprise a tubular shape, as illustrated in FIG. 1. In alternate embodiments the carrier 10 instead take the form of a conical shape, or other shapes depending on the specific application. The carrier 10 in FIG. 1 is illustrated as a spirally wound carrier 10 in which strips of material are helically wrapped, but cores in accordance with the invention can instead be convolutedly wrapped.

Figure 2:
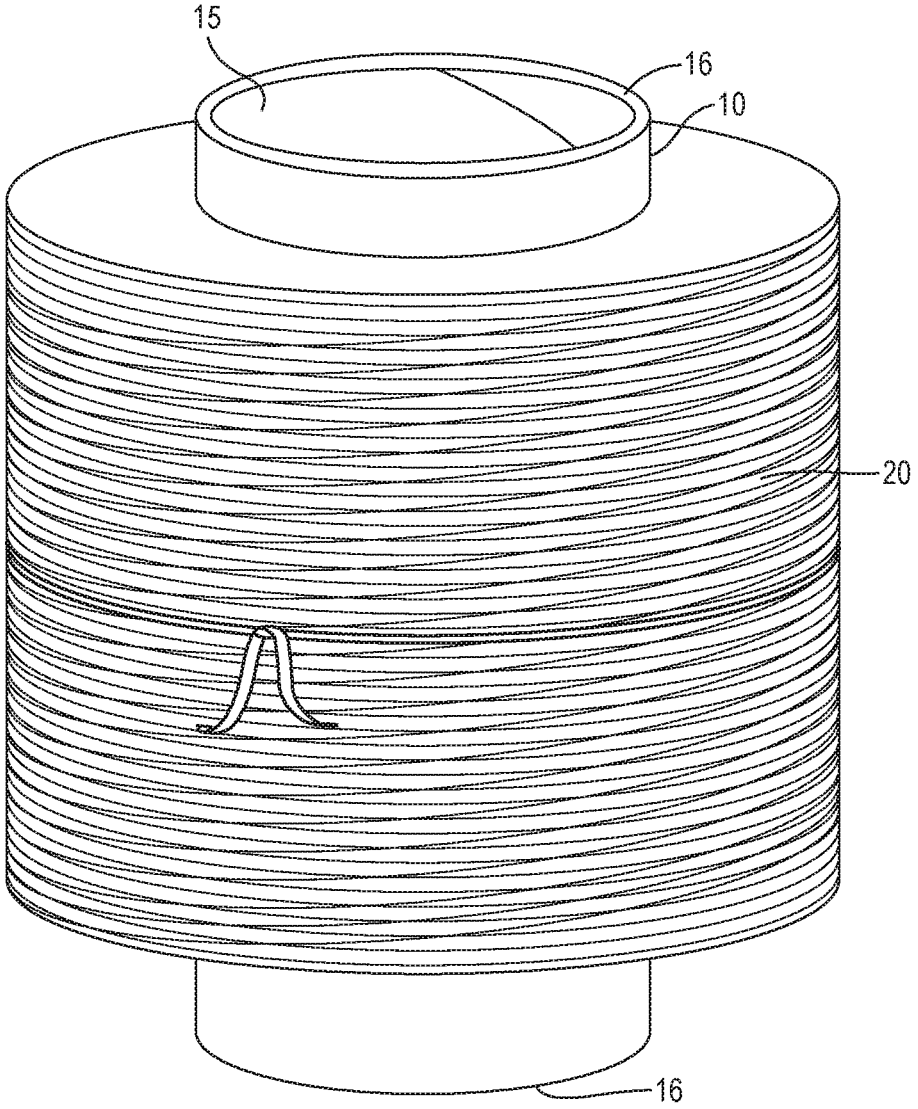
FIG. 2 is a perspective view of a tube carrying wound strand material.

FIG. 2 is a perspective view of a carrier 10 carrying wound strand material 20, for example, yarn. If the carrier 10 is to be used to carry a textile, the carrier 10 may sold to the textile manufacturer who then winds their product 20 on the carrier 10.

Method of Making the Carrier 10

Figure 3:
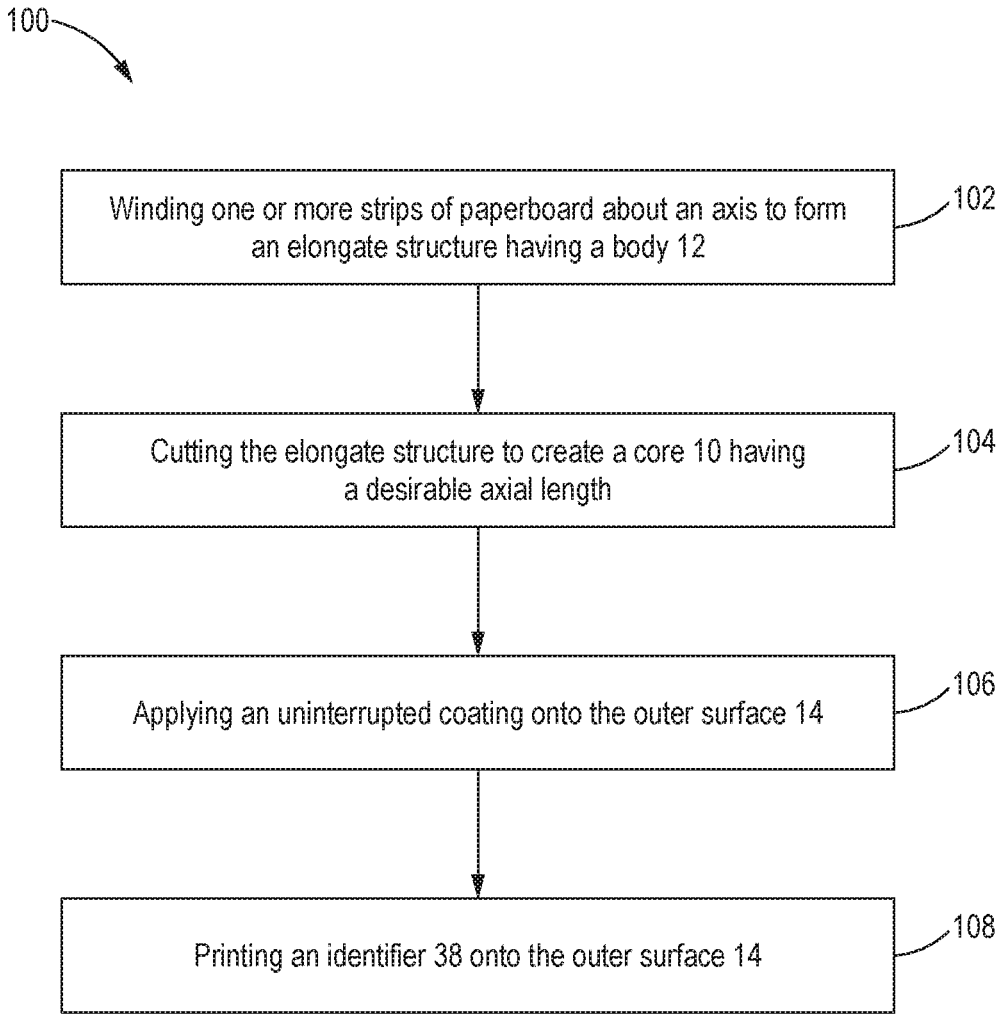
FIG. 3 is a flowchart of a method of making a tube according to the disclosure.

FIG. 3 illustrates an embodiment of a method 100 of manufacturing a carrier 10 according to this disclosure.

Winding

In a first operation 102, the method 100 comprises winding one or more strips of paperboard about an axis (A) to form an elongate structure having a body 12. The body 12 has an outer surface 14 facing away from the axis (A) and adapted to receive ("carry") a wound material thereon, and an inner surface 15 facing the axis (A). Each of the plurality of annular strips may be applied individually.

Figure 4:
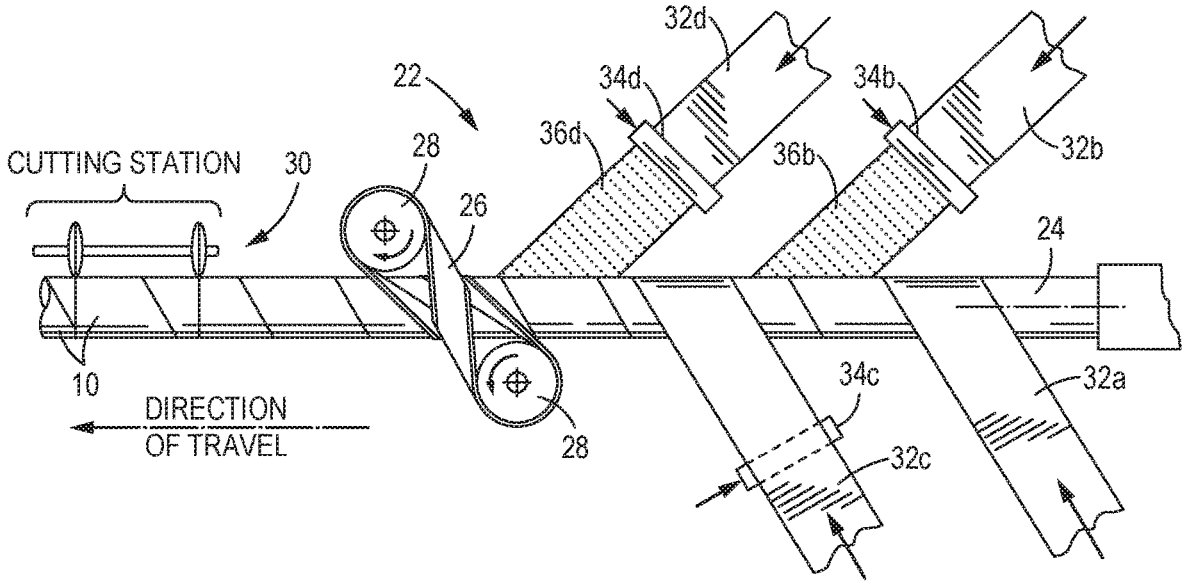
FIG. 4 is a schematic depiction of a tube being formed and cut.

The winding operation 102 may be achieved through conventional means, such as that described in co-owned U.S. Patent Publication No. 2005/0260365, which now will be briefly described with reference to FIG. 4. The illustrated winding apparatus 22 is a spiral winding apparatus for making spirally or helically wound tubes 10, one of which is depicted in FIG. 1. This particular winding apparatus 22 is used to manufacture a 4-ply tube, but the principles pertaining to the 4-ply tube are equally applicable to tubes having any number of plies. The winding apparatus 22 includes a cylindrical mandrel 24 whose diameter is selected to match the desired inside diameter of the tubes 10 to be manufactured, a winding belt 26 arranged to wrap about the tube formed on the mandrel 24 and about a pair of rotating drums 28 that drive the belt 26 such that the belt 26 advances the tube along the mandrel 24 in screw fashion at a substantially constant pitch. Four strips 32*a*, 32*b*, 32*c*, and 32*d* are drawn from respective supply rolls (not shown) and are advanced toward the mandrel 24 and are sequentially wrapped about the mandrel 24 in radially superposed fashion, one atop another. The winding apparatus 22 may include adhesive applicators 34*b*, 34*c*, and 34*d* for applying adhesive to each of strips 32*b*, 32*c*, and 32*d*, respectively. The adhesive applicators are structured and arranged so as to apply the adhesive to each of strips 32*b*, 32*c*, and 32*d*, such as in the partial-coverage patterns 36*b* and 36*d* shown in FIG. 4.

Cutting

In a second operation 104, the elongate structure is cut to create a tube 10 having opposing first and second ends 16 and desirable axial length. Referring again to FIG. 4, a cutting station 30 downstream of the winding apparatus may be used to cut the continuous tube formed on the mandrel 24 into individual tubes 10.

Coating

In a third operation 106, the method 100 comprises applying a coating 50 onto the outer surface 14 of the tube or carrier 10 in predetermined regions. The coating operation 106 may take a number of different forms.

Coating Application Methods

For example, the step 106 of applying a coating 50 may comprise roll-coating a coating 50 onto the outer surface 14 of the carrier 10. The step of roll-coating may comprise rotating the paperboard carrier 10 against a rotating cylinder that is partially immersed in the coating 50.

Alternatively, the coating 50 may be applied onto the outer surface 14 using a wick, brush, or the like.

Figure 5:
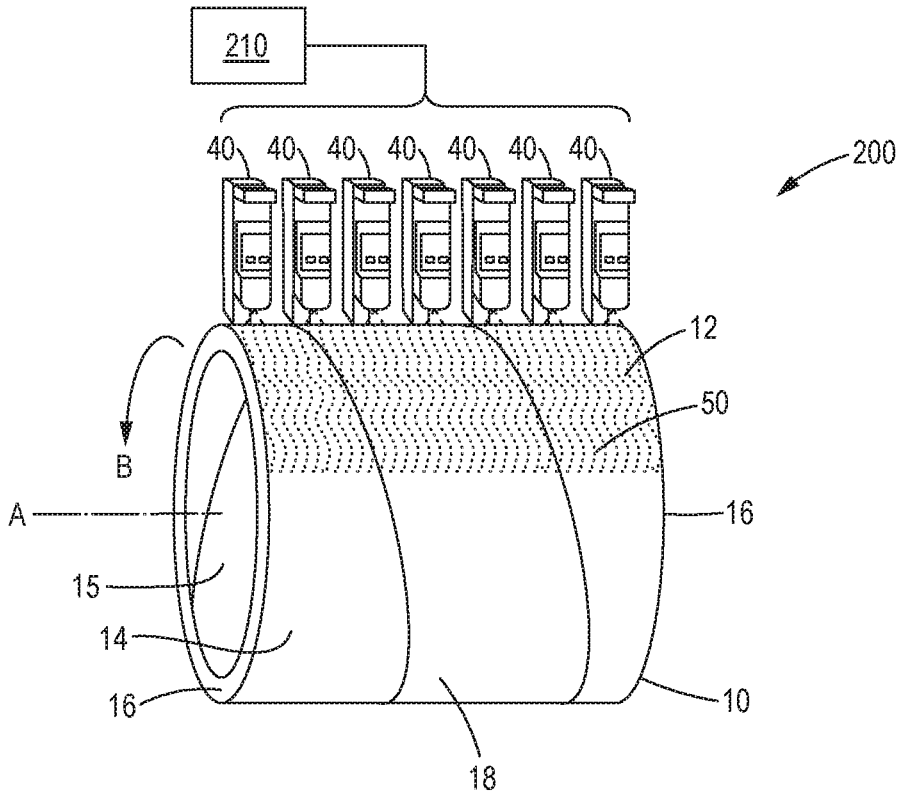
FIG. 5 is a schematic depiction of a tube being coated with a protective barrier coating.

Preferably the coating 50 is applied to the outer surface 14 by spraying. FIG. 5 is a schematic depiction of a carrier 10 being spray coated.

Number of Layers.

The step 106 of applying the coating 50 may comprise applying a single layer of the coating 50. Alternatively, the step 106 of applying the coating 50 comprises applying a plurality of layers of the coating 50.

Uninterrupted Coating 50.

The step 106 of applying a coating 50 may further comprise creating a substantially uninterrupted coating 50 on the outer surface 14. In this regard, a paperboard carrier 10 with a coating 50 may avoid overlapping joints or gaps associated with use of a specialty covering. The coating 50 may comprise and may be applied as a plurality of annular bands arranged along the carrier 10 in the axial direction such that the coating 50 is uninterrupted.

The coating operation 106 may be accomplished by coating the elongated, uncut tube prior to it being advanced to the cutting station, or to the finished cut carrier 10.

Alternative Method of Making the Carrier 10

Instead of coating the elongated, uncut tube or finished cut carrier 10, the coating 50 may be applied to the paperboard strips or plies 32 used to make the carrier 10. For example, the step 106 of applying the coating 50 may comprise coating the radially outer surface of at least one of the one or more strips 32 prior to the step 102 of winding the one or more strips 32 about the mandrel 24.

The coating 50 may be dried or otherwise cured. Multiple layers of the coating 50 may be sequentially applied and cured individually. However, it is expected that the diluted composition of the coating 50 will eliminate the need for heated curing to achieve the desired barrier properties.

The Coating Composition

The liquid coating 50 comprises a coating agent, a solvent and little or no water. The coating agent may be dispersed in the solvent.

The coating agent may be a fluorourethane copolymer, a silicone resin, a fluoroalkyl acrylate copolymer emulsion or any other suitable coating agent.

The solvent may be acetone, isopropyl alcohol (IPA), methyl alcohol, n-butyl acetate, mineral spirits, or other suitable solvent.

In one formulation the coating 50 is a silicone formulation such as a silicone resin dispersed in isopropyl alcohol (IPA) in relative amounts that achieve desirable flow and spray characteristics, with little or no water. The concentration of the silicone resin in the IPA may range from 1 to 10 percent or higher. This chemical formulation allows for very fast curing times in air, eliminating the need for heated drying. This chemical formulation also allows the tube manufacturer to apply the coating 50 very close to the packing station without causing dimensional instability of the tubes. Finally, this formulation enables the tube manufacturer to print on the cores during the finishing process, applying the coating 50 and packing the tubes in a single unit.

The silicone resin may be a reactive silicone resin, that is, one that produces a durable moisture barrier when applied to a substrate. The silicone resin may comprise a siloxane. More particularly, the silicone resin may comprise silicone resin and octamethylcyclotetrasiloxane. Still more particularly, the silicone resin may comprise 50% silicone resin and 50% octamethylcyclotetrasiloxane.

In another formulation the coating 50 comprises about 50% fluoroalkyl acrylate copolymer emulsion and about 50% methyl alcohol. The coating 50 may be a predetermined color used to identify a type of tube.

The coating 50 may achieve a desired barrier characteristic. For example, the coating 50 may provide superior oil or chemical resistance.

The concentration of the coating agent in the solvent can be tailored to the production equipment and the textile coatings that the customer (such as a textile manufacturer) might use or develop. Should the customer develop a more aggressive textile coating, the tube manufacturer can increase the concentration of the tube coating material to obtain the desired barrier properties.

System for Making a Coated Carrier 10

In accordance with this disclosure a system 200 for making a coated carrier 10 is provided. Referring to FIG. 5, a completed, cut cylindrical paperboard carrier 10 is shown. The carrier 10 comprises one or more strips 32 of paperboard that have been wrapped around a mandrel and secured together to form an elongate structure, then cut to a desired length. The completed carrier 10 is an elongate structure defining a central axis (A) and having an outer surface 14 and an inner surface 15.

The system 200 comprises a plurality of spray nozzles 40 and a controller 210. The spray nozzles 40 apply the coating 50 onto the outer surface 14 of the carrier 10. The spray nozzle 40 may be arranged in an axial orientation with respect to the carrier 10. The spray nozzles 40 may be arranged in a linear or non-linear array in order to apply individual bands of coating 50. Each band of coating may extend circumferentially or longitudinally around the carrier 10, depending on the arrangement of the spray nozzles 40. For example, FIG. 5 shows a carrier 10 on which a coating 50 has been partially applied.

The spray nozzles 40 may be arranged in a linear array along the length of the carrier 10, parallel to the axis (A), and thus each spray nozzle 40 may apply a band of coating 50 around the circumference of the carrier 10 as the carrier is rotated around its axis (A) in the direction of arrow (B). Alternatively, the spray nozzles 40 may be arranged circumferentially around the carrier 10 so that each spray nozzle 40 lays down a band of coating 50 along the length of the carrier 10. The bands may be non-contiguous, leaving parts of the carrier 10 uncoated, or contiguous so that an uninterrupted coating 50 is applied to the carrier 10. The bands may be any suitable width.

The controller 210 is operably connected to the plurality of spray nozzles 40 to control the operation of the nozzles 40. For example, the controller 210 may turn the spray nozzles 40 on and off in response to operator input, time, or sensors that sense when the coating has been applied and communicate that information to the controller 210.

EXAMPLES

Experimental tests were conducted on substrates coated with various coatings at various concentrations. The results are summarized in Table 1 below.

TABLE 1

COATINGS

| Example | Agent | Solvent | Majer Rod | Substrate | Dyne | Contact angle, deg. |
|---|---|---|---|---|---|---|
| Control | 0 | 0 | | Parchment | 67 | 34 |
| 1 | 15% fluorourethane copolymer | 85% Acetone | #18 | parchment | 42 | 86 |
| 2 | 20% fluorourethane copolymer | 80% Acetone | #18 | parchment | 42 | 89 |
| 3 | 10% silicone resin | 90% IPA* | #18 | parchment | 40 | 109 |
| 4 | 4% Fluoroalkyl acrylate copolymer emulsion | 96% water | #6 | parchment | 30 | 98 |
| 5 | 4% Fluoroalkyl acrylate copolymer emulsion | 96% water | #10 | parchment | 29 | 101 |
| 6 | 4% Fluoroalkyl acrylate copolymer emulsion | 96% water | #14 | parchment | 31 | 93 |
| 7 | 4% Fluoroalkyl acrylate copolymer emulsion | 96% water | #18 | parchment | 28 | 102 |
| 8 | 10% silicone resin | 90% IPA | #10 | parchment | 31 | 95 |
| 9 | 10% silicone resin | 90% IPA | #14 | parchment | 27 | 105 |
| 10 | 10% silicone resin | 90% IPA | #18 | parchment | 29 | 100 |
| 11 | 4% Fluoroalkyl acrylate copolymer emulsion | 96% water | #6 | Clay coated kraft paper | 30 | 98 |
| 12 | 4% Fluoroalkyl acrylate copolymer emulsion | 96% water | #10 | Clay coated kraft paper | 29 | 101 |
| 13 | 4% Fluoroalkyl acrylate copolymer emulsion | 96% water | #14 | Clay coated kraft paper | 31 | 93 |
| 14 | 4% Fluoroalkyl acrylate copolymer emulsion | 96% water | #18 | Clay coated kraft paper | 28 | 102 |
| 15 | 4% silicone resin | 96% IPA | #6 | Clay coated kraft paper | 29 | 101 |

TABLE 1-continued

| COATINGS | | | | | | |
|---|---|---|---|---|---|---|
| Example | Agent | Solvent | Majer Rod | Substrate | Dyne | Contact angle, deg. |
| 16 | 4% silicone resin | 96% IPA | #10 | Clay coated kraft paper | 31 | 95 |
| 17 | 4% silicone resin | 96% IPA | #14 | Clay coated kraft paper | 27 | 105 |
| 18 | 4% silicone resin | 96% IPA | #18 | Clay coated kraft paper | 29 | 100 |

Examples 1-3

A fluorourethane copolymer was dissolved in acetone at 15% copolymer/85% acetone and at 20% copolymer/80% acetone. The solution was applied to parchment paper substrate using a #18 Majer Rod. Similarly, a silicone resin was dissolved in isopropyl alcohol (IPA-98.9% pure) at 10% concentration of the silicone resin and applied to a parchment paper substrate. The coated substrates were submitted for surface energy characterization, a key indicator of barrier properties.

Contact Angle and Surface Energy Testing

A KRŰSS Mobile Surface Analyzer was used to digitally measure contact angle of water drops (1.0 μL) applied to the sample surface. The Surface Free Energy was calculated using the ORWK model. The instrument and software were configured in accordance with ASTM D5946. Ten measurements were taken from each variable. A high contact angle will indicate low wettability or high barrier properties.

Dyne Testing with AccuDyne Test™ Solutions Per ASTM D2578

Dyne testing was performed by first selecting the lowest-numbered dyne solution. A clean cotton-tipped swab was dipped in the solution. A line was wiped onto the test material with the moistened swab. If the mark stayed wetted, i.e. did not bead up, for more than 3 seconds, the procedure was repeated with higher numbered solution until a mark was made that did bead up, shrink, or form a single line in 2 to 3 seconds. The dyne level of this solution was recorded. If the mark beaded very quickly, the dyne level of the solution was considered too high. The lower the dyne level measured, the higher the barrier properties are, indicating poor wettability.

TABLE 2

| EXAMPLES 1-3 | | | |
|---|---|---|---|
| Example | Dyne Solution - dynes | Contact Angle, degrees | Surface Free Energy (calculated from Contact Angle), dynes |
| Control | 67 | 34 | |
| 1 | 42 | 86 | 34 |
| 2 | 42 | 89 | 34 |
| 3 | 40 | 109 | 21 |

From the results shown on Table 2 it can be seen that the application of the solutions on the parchment result in a lower surface energy/higher contact angle, confirming a less wettable, more water resistant, parchment surface than the untreated control.

Examples 4-10

A Fluoroalkyl acrylate copolymer emulsion was dissolved in water at 4% Fluoroalkyl acrylate copolymer emulsion/96% water. The solution was applied to parchment paper substrate using a graduated series of Majer Rods. Similarly, a silicone resin was dissolved in isopropyl alcohol (IPA-98.9% pure) at 4% concentration of the silicone resin and applied to a parchment paper substrate using a series of Majer rods. These coated substrates were submitted for surface energy characterization via Dyne Solutions and Contact Angle. Surface energy is a key indicator of wettability and/or barrier properties.

Contact Angle and Surface Energy Testing

A KRŰSS Mobile Surface Analyzer was used to digitally measure contact angle of water drops (1.0 μL) applied to the sample surface. The Surface Free Energy was calculated using the ORWK model. The instrument and software were configured in accordance with ASTM D5946. Ten measurements were taken from each variable. A high contact angle will indicate low wettability or high barrier properties.

Dyne Testing with AccuDyne Test™ Solutions Per ASTM D2578

Dyne testing was performed by first selecting the lowest-numbered dyne solution. A clean cotton-tipped swab was dipped in the solution. A line was wiped onto the test material with the moistened swab. If the mark stayed wetted, i.e. did not bead up, for more than 3 seconds, the procedure was repeated with higher numbered solution until a mark was made that did bead up, shrink, or form a single line in 2 to 3 seconds. The dyne level of this solution was recorded. If the mark beaded very quickly, the dyne level of the solution was considered too high. The lower the dyne level measured, the higher the barrier properties are, indicating poor wettability.

From the results shown in Table 1 it can be seen that the surface energy, as measured by the contact angle method, generally decreased with higher application rates, for both solutions applied on the parchment substrate. This is shown by higher contact angles when using a higher number Majer Rod. The surface energy as measured by the Dyne Level method, also decreased with higher application rates, for both solutions applied on the parchment substrate. The Dyne Level obtained with higher application rates is lower than the Dyne Level obtained with lower application rate.

Examples 11-18

A Fluoroalkyl acrylate copolymer emulsion was dissolved in water at 4% Fluoroalkyl acrylate copolymer emulsion/96% water. The solution was applied to a clay coated 35 lbs./3000 $ft^2$ paper substrate using a graduated series of Majer Rods. Similarly, a silicone resin was dissolved in isopropyl alcohol (IPA-98.9% pure) at 4% concentration of the silicone resin and applied to a clay coated 35 lbs./3000 $ft^2$ paper substrate using a series of Majer rods. These coated substrates were submitted for surface energy characterization via Dyne Solutions and Contact Angle. Surface energy is a key indicator of wettability and/or barrier properties.

The results shown in Table 1 above indicate that the fluoroalkyl acrylate copolymer emulsion provides good barrier properties on the clay coated sheet at different amounts of coating applied using different Majer Rods. Increasing the concentration or amount of the silicone resin applied to the clay coated sheet did not result in large changes in surface energy reduction, as measured by Dyne Level and Contact Angle results.

Inks with Barrier Properties

It can be advantageous to print an identifier 38 on the outer surface 14 of the carriers 10, especially near the exposed ends 16, to create a "printed" carrier 10. The identifier 38 may be a name, a color, a symbol, a machine readable code or any other suitable identifier 38. For printing the identifier 38 an ink having barrier properties may be used.

Accordingly, in an optional fourth operation, the method 100 of manufacturing a carrier 10 may comprise the additional step 108 of printing an identifier 38 onto the outer surface 14 of the body 12 near one or both of the ends 16. The printing step 108 may be done using ink jet printing or any suitable manner of applying an ink to cylindrical surface.

The printing step 108 may be done before the coating step 106 so that the identifier is coated and thus protected from textile coatings. Alternatively, the printing step 108 may be done after the coating step 106 or even instead of the coating step 106. In such instances the ink should have a stain resistant formulation that incorporates a barrier compound or chemical, since a potential problem with some inks is the potential color transfer from the ink to the customer product 20, e.g., wound yarn. This unwanted color transfer may result from the use by textile manufacturers of aggressive chemical formulations in their textiles that can extract the ink contained in the identifier 38 printed on the outer surface 14 of the carrier 10. By using an ink having barrier properties, the ink can be protected from the chemicals in the wound products and vice versa.

EXAMPLES

Aqueous Based Inks with Barrier Properties

The ink used to make the identifier 38 may comprise an aqueous based ink and a barrier compound. The barrier compound comprised perflouroalkyl acrylic copolymers.

Fifteen (15) different aqueous based ink formulations, five each for three different barrier mixtures, were created and evaluated for color pick-up by swab testing:

Barrier Mixture #1 (20% Active) Compound:

Control: 100% Aqueous based ink

Sample 1: 70% aqueous based ink and 30% barrier compound;

Sample 2: 60% aqueous based ink and 40% barrier compound;

Sample 3: 50% aqueous based ink and 50% barrier compound;

Sample 4: 40% aqueous based ink and 60% barrier compound;

Sample 5: 30% aqueous based ink and 70% barrier compound;

Barrier Mixture #2 (20% Active) Compound:

Control: 100% Aqueous based ink

Sample A: 70% aqueous based ink and 30% barrier compound;

Sample B: 60% aqueous based ink and 40% barrier compound;

Sample C: 50% aqueous based ink and 50% barrier compound;

Sample D: 40% aqueous based ink and 60% barrier compound;

Sample E: 30% aqueous based ink and 70% barrier compound;

Barrier Mixture #3 (20% Active) Compound:

Control: 100% Aqueous based ink

Sample I: 70% aqueous based ink and 30% barrier compound;

Sample II: 60% aqueous based ink and 40% barrier compound;

Sample III: 50% aqueous based ink and 50% barrier compound;

Sample IV: 40% aqueous based ink and 60% barrier compound;

Sample V: 30% aqueous based ink and 70% barrier compound;

All fifteen samples demonstrated improved ink smear/stain resistance over the control. In a separate test, an ink comprising 90% aqueous ink and only 10% barrier compound demonstrated improved ink smear/stain resistance over a control lacking any barrier compound.

Solvent Based Inks with Barrier Properties

Alternatively, the ink used to make the identifier 38 may comprise a solvent based ink and a barrier compound.

Twelve (12) different solvent based ink formulations were created and evaluated for color pick-up by swab testing. In six of the twelve examples, a barrier compound was mixed with a water based ink. In six other examples, a barrier compound was mixed with a solvent (oil) based ink.

The barrier compound was a perflouroalkyl acrylic copolymer barrier coating, diluted in methanol to achieve a 1%, 2% or 10% active level.

In each case a barrier compound was diluted with methanol to create a barrier mixture, then mixed with the solvent based ink at a rate of 5 parts ink to 1 part barrier mixture to create the ink formulation. The ink formulation was applied to a paper substrate using a cotton swab to create a coated paper. The coated paper was then swabbed with textiles having different chemistries to determine color pick-up, and thus the barrier properties of the ink mixture.

TABLE 3

SWAB TESTING OF WATER AND SOLVENT BASED INKS WITH BARRIER PROPERTUES

| | Ink Only (No barrier) | 1% Active | 2% Active | 10% Active |
|---|---|---|---|---|
| 60% water based chemistry | 3 | 2 | 2.5 | 3 |
| 80% water based chemistry | 3 | 2 | 1.5 | 2 |
| Heavy oil based chemistry | 2 | 1.5 | 2 | 1.5 |
| Oil base chemistry | 1.5 | 2 | 1.5 | 1 |

A lower swab score indicates lower color pick-up, which is desirable. Of the six water based samples tested, five demonstrated lower color pick-up, and thus improved ink smear/stain resistance, over the control. Of the six solvent (oil) based samples tested, three demonstrated lower color pick-up, and thus improved ink smear/stain resistance, over the control.

INDUSTRIAL APPLICABILITY

Thus, it is possible to achieve a desired barrier level for a paperboard core at least in part by coating the paperboard core 10 with a coating 50 comprising a silicone resin in a solvent and little or no water. An advantage of this coating 50 and method is that the coating 50 does not need to be heat cured. Variables such as the thickness of the coating 50 may affect the barrier properties, and hence may be adjusted in order to obtain the desired properties of the paperboard core.

It also is possible to achieve a paperboard core bearing a printed identifier by using an ink comprising a barrier compound. By using an ink having barrier properties, the ink can be prevented from transferring to the wound product, and chemicals in the wound product can be prevented from transferring into the ink.

It should be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

The invention claimed is:

1. A paperboard carrier suitable for use in winding a material thereon, the carrier comprising:

one or more strips of paperboard secured together to form an elongate structure, the elongate structure defining an outer surface; and a non-aqueous coating disposed on the outer surface in a predetermined region, the coating comprising a coating agent and a solvent, wherein:

the solvent is selected from the group consisting of acetone, methyl alcohol and isopropyl alcohol; and the coating is not heat cured.

2. The paperboard carrier of claim 1, wherein:

the coating agent is selected from the group consisting of a fluorourethane copolymer, a silicone resin and a fluoroalkyl acrylate copolymer emulsion; and the solvent is selected from the group consisting of acetone, methyl alcohol and isopropyl alcohol.

3. The paperboard carrier of claim 2, wherein:

the coating consists essentially of the coating agent and the solvent.

4. The paperboard carrier of claim 1, wherein:

the coating agent is a fluorourethane copolymer; and the solvent is acetone.

5. The paperboard carrier of claim 4, wherein:

the coating comprises about 10% to about 20% fluorourethane copolymer and from about 80% to about 90% acetone.

6. The paperboard carrier of claim 1, wherein:

the coating agent is a silicone resin; and the solvent is isopropyl alcohol.

7. The paperboard carrier of claim 6, wherein:

the coating comprises about 4% to about 10% silicone resin and from about 90% to about 96% isopropyl alcohol.

8. The paperboard carrier of claim 6, wherein:

the silicone resin comprises a siloxane.

9. The paperboard carrier of claim 6, wherein:

the silicone resin comprises silicone resin and octamethylcyclotetrasiloxane.

10. The paperboard carrier of claim 6, wherein:

the silicone resin comprises about 50% silicone resin and about 50% octamethylcyclotetrasiloxane.

11. The paperboard carrier of claim 1, wherein:

the coating agent is a fluoroalkyl acrylate copolymer emulsion; and the solvent is methyl alcohol.

12. The paperboard carrier of claim 1, wherein:

the coating comprises about 50% fluoroalkyl acrylate copolymer emulsion and about 50% methyl alcohol.

13. A paperboard carrier suitable for use in winding a material thereon, the carrier comprising:

one or more strips of paperboard secured together to form a cylindrical elongate structure, the cylindrical elongate structure defining an outer surface; and an ink identifier printed onto the outer surface in a predetermined region, the ink identifier comprising ink and a room temperature cured, water free barrier compound, the ink identifier having a barrier property that minimizes the transfer of chemicals between the ink identifier and the material.

14. The paperboard carrier of claim 13 wherein:

the ink is an aqueous based ink.

15. The paperboard carrier of claim 13 wherein:

the ink is a solvent based ink.

16. A method of manufacturing a paperboard carrier of claim 1 suitable for use in winding materials thereon, the method comprising the steps of:

in a first operation, winding one or more strips of paperboard about a mandrel to form an elongate structure defining an axis (A), the elongate structure having a cylindrical body, the cylindrical body having an outer surface and opposing first and second ends;

in a second operation, cutting the elongate structure to create a carrier having a desirable axial length; and in a third operation, using a plurality spray nozzles to apply a coating onto the outer surface.

17. The method of claim 16, wherein:

in the third operation, the plurality spray nozzles applies a coating onto the outer surface of the elongate structure prior to the second, cutting operation.

18. The method of claim 16 further comprising:

in a fourth operation, printing an ink identifier onto one or both of the cylindrical body ends after the coating operation; wherein the ink identifier comprises a barrier chemical.

* * * * *